US011336044B2

(12) United States Patent
Masuda

(10) Patent No.: US 11,336,044 B2
(45) Date of Patent: May 17, 2022

(54) TERMINAL, CONNECTOR, TERMINAL PAIR AND CONNECTOR PAIR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventor: Takeshi Masuda, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 94 days.

(21) Appl. No.: 16/805,918

(22) Filed: Mar. 2, 2020

(65) Prior Publication Data

US 2020/0295488 A1 Sep. 17, 2020

(30) Foreign Application Priority Data

Mar. 11, 2019 (JP) ..... JP2019-044310

(51) Int. Cl.
*H01R 13/03* (2006.01)
*H01R 13/04* (2006.01)
*H01R 13/11* (2006.01)

(52) U.S. Cl.
CPC ..... *H01R 13/03* (2013.01); *H01R 13/04* (2013.01); *H01R 13/112* (2013.01)

(58) Field of Classification Search
CPC ... H01R 13/04; H01R 13/112; C23C 18/1692; C23C 18/52; C22C 9/02; C22C 13/00; C25D 5/505; C25D 5/16; C25D 5/02
See application file for complete search history.

(56) References Cited

U.S. PATENT DOCUMENTS 7,029,760 B2 * 4/2006 Mori ..... H01R 13/03 428/600
8,342,895 B2 * 1/2013 Yoshida ..... C25D 5/10 439/886

FOREIGN PATENT DOCUMENTS

JP 2000-021545 A 1/2000
JP 2004179055 A * 6/2004 ..... H01R 13/03
JP 2015-149200 A 8/2015

OTHER PUBLICATIONS

Suzuki, TAKESHIJP2004179055 translation of description (Year: 2004).*

* cited by examiner

*Primary Examiner* — Briggitte R. Hammond

(74) *Attorney, Agent, or Firm* — Abelman, Frayne & Schwab

(57) ABSTRACT

A terminal includes a connecting portion to be electrically connected to a mating terminal by being inserted into the mating terminal. The connecting portion has a sliding region configured to slide on the mating terminal and a contact region configured to contact the mating terminal successively from a tip side. An outermost surface in the sliding region includes a copper-tin alloy layer containing copper and tin. An outermost surface in the contact region includes a tin layer containing tin as a main component. A Vickers hardness of the copper-tin alloy layer is higher than a Vickers hardness of the tin layer.

18 Claims, 4 Drawing Sheets

TERMINAL, CONNECTOR, TERMINAL PAIR AND CONNECTOR PAIR

CROSS-REFERENCE TO RELATED APPLICATIONS

This application is based on and claims priority from Japanese Patent Application No. 2019-044310, filed on Mar. 11, 2019, with the Japan Patent Office, the disclosure of which is incorporated herein in its entirety by reference.

TECHNICAL FIELD

The present disclosure relates to a terminal, a connector, a terminal pair and a connector pair.

BACKGROUND

Conventionally, it is known to provide a tin layer (hereinafter, referred to as a "Sn layer" in some cases) by applying a reflow process after tin (Sn) plating is applied to a surface of a terminal to be provided in a connector. It is also known to form a copper-tin alloy layer (hereinafter, referred to as a "Cu—Sn alloy layer" in some cases) by applying a reflow process for alloying of Cu and Sn after copper (Cu) plating and tin (Sn) plating are successively applied to a surface of a terminal.

Japanese Patent Laid-open Publication No. 2000-021545 discloses a connection terminal manufacturing method for forming a Cu—Sn alloy layer near an interface with a copper base material, out of a Sn plating layer in a slide-contact part with a mating terminal, by irradiating a laser beam to the slide-contact part after the Sn plating layer is formed on a surface of the copper base material for forming a terminal. Japanese Patent Laid-open Publication No. 2015-149200 discloses a connector terminal in which a contact portion to be held in contact with a mating terminal has a Cu—Sn alloy layer and a Sn layer and both a Cu—Sn alloy portion formed by exposing the Cu—Sn alloy layer and a Sn portion formed by exposing the Sn layer are present on a surface of the contact portion. Specific examples of a state where both the Sn alloy portion and the Sn portion are present include a sea-island structure in which island phases formed by a Cu—Sn alloy portion are scattered in a sea phase formed by a Sn portion and a sea-island structure in which island phases formed by a Sn portion are scattered in a sea phase formed by a Cu—Sn alloy portion.

SUMMARY

A terminal requiring a low insertion force into a mating terminal and a low contact resistance with the mating terminal is desired as a terminal used in a connector. Particularly, in recent years, the multipolarization of in-vehicle connectors has been progressing with an increase in electronic components to be mounted in automotive vehicles. In a multipolar connector with a plurality of terminals, it is desired to reduce an insertion force necessary for the connection of the connector in order to facilitate a connecting operation of the connector. Thus, it is important to reduce an insertion force per terminal. Further, in an in-vehicle connector, it is important to suppress contact resistance by stabilizing contact with a mating terminal even in the case of receiving vibration.

One object of the present disclosure is to provide a terminal capable of reducing contact resistance with a mating terminal while reducing an insertion force into the mating terminal, and a connector provided with the terminal. Another object of the present disclosure is to provide a terminal pair capable of reducing contact resistance between a male terminal and a female terminal while reducing an insertion force of the male terminal into the female terminal, and a connector pair provided with the terminal pair.

A terminal of the present disclosure includes a connecting portion to be electrically connected to a mating terminal by being inserted into the mating terminal, wherein the connecting portion has a sliding region configured to slide on the mating terminal and a contact region configured to contact the mating terminal successively from a tip side, an outermost surface in the sliding region includes a copper-tin alloy layer containing copper and tin, an outermost surface in the contact region includes a tin layer containing tin as a main component, and a Vickers hardness of the copper-tin alloy layer is higher than a Vickers hardness of the tin layer.

A connector of the present disclosure includes the terminal of the present disclosure and a housing for accommodating the terminal.

A terminal pair of the present disclosure includes a male terminal, and a female terminal, the male terminal being inserted into the female terminal, the male terminal being the terminal of the present disclosure.

A connector pair of the present disclosure includes the terminal pair of the present disclosure, a male connector including the male terminal, and a female connector including the female terminal.

The terminal and connector of the present disclosure can reduce contact resistance with the mating terminal while reducing an insertion force into the mating terminal. The terminal pair and connector pair of the present disclosure can reduce contact resistance between the male terminal and the female terminal while reducing an insertion force of the male terminal into the female terminal.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
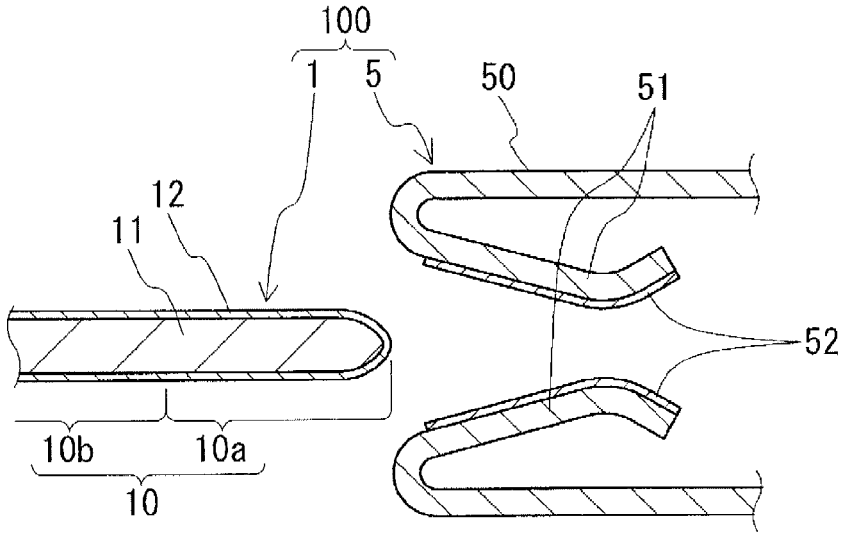
FIG. 1 is a schematic partial section of examples of a terminal and a terminal pair according to an embodiment showing a state before insertion.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

As a result of various studies on connector terminals, the present inventors obtained the following knowledge.

If a Sn layer is present on a surface of a terminal, contact with a mating terminal can be stabilized since the Sn layer is relatively soft. As a result, contact resistance with the mating terminal can be reduced. However, since the Sn layer is low in hardness, a friction coefficient is high. Thus, an insertion force into the mating terminal increases. On the other hand, if a Cu—Sn alloy layer is present on a surface of a terminal, an insertion force into a mating terminal can be reduced since the Cu—Sn alloy layer has a higher hardness than Sn. However, since the Cu—Sn alloy layer is hard, it is difficult to stably maintain contact resistance with the mating terminal.

A technique described in Japanese Patent Laid-open Publication No. 2000-021545 proposes to stably reduce contact resistance while reducing an insertion force by forming the Cu—Sn alloy layer near an interface between a Sn layer and a copper base material in a slide-contact portion. However, since the Sn layer remains on the Cu—Sn alloy layer in the slide-contact portion with the technique described in Japanese Patent Laid-open Publication No. 2000-021545, it is thought to be difficult to sufficiently obtain an effect of reducing the insertion force by the Cu—Sn alloy layer.

A technique described in Japanese Patent Laid-open Publication No. 2015-149200 proposes to combine a reduction of an insertion force and a reduction of contact resistance by forming both a Cu—Sn alloy layer and a Sn layer on a surface of a contact portion. However, since both the Cu—Sn alloy layer and the Sn layer are present on the surface of the contact portion with the technique described in Japanese Patent Laid-open Publication No. 2015-149200, an effect of reducing contact resistance by the Sn layer is thought to be small as compared to a structure in which the entire surface is formed by the Sn layer.

As a result of continued earnest study, the present inventors found out that a reduction of an insertion force and a reduction of contact resistance could be effectively combined by making materials of outermost surfaces different in a sliding region configured to slide on a mating terminal and a contact region configured to contact the mating terminal.

DESCRIPTION OF EMBODIMENTS OF PRESENT DISCLOSURE

First, embodiments of the present disclosure are listed.

(1) A terminal according to an embodiment of the present disclosure includes a connecting portion to be electrically connected to a mating terminal by being inserted into the mating terminal, wherein the connecting portion has a sliding region configured to slide on the mating terminal and a contact region configured to contact the mating terminal successively from a tip side, an outermost surface in the sliding region includes a copper-tin alloy layer containing copper and tin, an outermost surface in the contact region includes a tin layer containing tin as a main component, and a Vickers hardness of the copper-tin alloy layer is higher than a Vickers hardness of the tin layer.

The terminal of the present disclosure has a hard surface in the sliding region by including the copper-tin alloy layer on the outermost surface in the sliding region. Thus, a friction coefficient in the sliding region is small. Therefore, an insertion force into the mating terminal can be reduced. Further, the terminal of the present disclosure can stabilize contact with the mating terminal and reduce contact resistance by including the tin layer on the outermost surface in the contact region. Thus, the contact resistance with the mating terminal can be reduced. Therefore, the terminal of the present disclosure can reduce the contact resistance with the mating terminal while reducing the insertion force into the mating terminal.

(2) As one aspect of the terminal of the present disclosure, the Vickers hardness of the tin layer is 20 Hv or more and 40 Hv or less.

Since the Vickers hardness of the tin layer is 20 Hv or more and 40 Hv or less, the contact resistance is easily stably maintained low. Thus, according to the above aspect, an effect of reducing the contact resistance by the tin layer is easily obtained.

(3) As one aspect of the terminal of the present disclosure, the Vickers hardness of the copper-tin alloy layer is 350 Hv or more and 630 Hv or less.

As the surface in the sliding region becomes harder, the friction coefficient tends to be smaller. Since the Vickers hardness of the copper-tin alloy layer is 350 Hv or more and 630 Hv or less, the friction coefficient is easily sufficiently reduced. Thus, according to the above aspect, an effect of reducing the insertion force by the copper-tin alloy layer is easily obtained.

(4) As one aspect of the terminal of the present disclosure, a thickness of the tin layer is 0.2 μm or more and 2.0 μm or less, and a thickness of the copper-tin alloy layer is 0.2 μm or more and 2.0 μm or less.

Since the thickness of the tin layer is 0.2 μm or more, the effect of reducing the contact resistance by the tin layer is easily obtained. If the tin layer is too thick, any further effect of reducing the contact resistance cannot be expected. Thus, an upper limit of the thickness of the tin layer is set at 2.0 μm or less. Further, since a thickness of the copper-tin alloy layer is 0.2 μm or more, the effect of reducing the insertion force by the copper-tin alloy layer is easily obtained. If the copper-tin alloy layer is too thick, any further effect of reducing the insertion force cannot be expected. Thus, an upper limit of the copper-tin alloy layer is set at 2.0 μm or less. Therefore, according to the above aspect, a reduction of the insertion force and a reduction of the contact resistance are easily combined.

(5) As one aspect of the terminal of the present disclosure, a width of the connecting portion is 0.3 mm or more and 3.0 mm or less.

According to the above aspect, a sufficient contact area with the mating terminal is easily secured since the width of the connecting portion is 0.3 mm or more and 3.0 mm or less.

(6) As one aspect of the terminal of the present disclosure, a length of the sliding region is 0.5 mm or more and 5.0 mm or less.

According to the above aspect, the insertion force into the mating terminal is easily sufficiently reduced since the length of the sliding region is 0.5 mm or more and 5.0 mm or less.

(7) As one aspect of the terminal of the present disclosure, a mass ratio of copper to tin is 1.0 or more and 2.5 or less in the copper-tin alloy layer.

The copper-tin alloy layer is made of a copper-tin based intermetallic compound containing copper and tin. Specific examples of the composition of the copper-tin based intermetallic compound include $Cu_6Sn_5$ and $Cu_3Sn$. $Cu_6Sn_5$ has a lower electrical resistance than $Cu_3Sn$. Thus, the copper-tin alloy layer preferably contains an intermetallic compound having the composition of $Cu_6Sn_5$. If a mass ratio of copper to tin is 1.0 or more and 2.5 or less in a copper-tin alloy layer, an intermetallic compound having the composition of $Cu_6Sn_5$ is easily formed. Thus, according to the above aspect, the electrical resistance of the copper-tin alloy layer can be reduced. Particularly, in the case of a multilayer structure in which a tin layer is formed on the copper-tin alloy layer in the contact region, the electrical resistance of the copper-tin alloy layer decreases. Thus, the electrical resistance in the contact region can be reduced.

(8) A connector according to an embodiment of the present disclosure includes the terminal of any one of (1) to (7), and a housing for accommodating the terminal.

The connector of the present disclosure can reduce the contact resistance with the male terminal while reducing the insertion force into the mating terminal. This is because the terminal of the present disclosure requiring a small insertion force and having a low contact resistance is provided.

(9) As one aspect of the connector of the present disclosure, two or more terminals are included.

According to the above aspect, a connector having a multipolar structure can be configured by including two or more terminals. Since an insertion force per terminal is small even if two or more terminals are included, an insertion force required to connect the connector can be small.

(10) A terminal pair according to an embodiment of the present disclosure includes a male terminal, and a female terminal, the male terminal being inserted into the female terminal, the male terminal being the terminal of any one of (1) to (7).

The terminal pair of the present disclosure can reduce contact resistance between the male terminal and the female terminal while reducing an insertion force of the male terminal into the female terminal. This is because the male terminal is the terminal of the present disclosure.

(11) As one aspect of the terminal pair of the present disclosure, a contact load of the female terminal with the male terminal inserted is 1.0 N or more and 10 N or less.

As the contact load of the female terminal increases, connection reliability between the male terminal and the female terminal is improved and the contact resistance tends to decrease. Further, since the contact load and the insertion force are in a proportional relationship, the insertion force of the male terminal into the female terminal decreases as the contact load of the female terminal decreases. By setting the contact load of the female terminal at 1.0 N or more, connection reliability between the male terminal and the female terminal is easily maintained. If the contact load of the female terminal exceeds 10 N, an effect of reducing the insertion force is hardly obtained even if the friction coefficient is small. Thus, an upper limit of the contact load of the female terminal is set at 10 N or less.

(12) A connector pair according to an embodiment of the present disclosure includes the terminal pair of (10) or (11), a male connector including the male terminal, and a female connector including the female terminal.

The connector pair of the present disclosure can reduce the contact resistance between the male terminal and the female terminal while reducing the insertion force of the male terminal into the female terminal by including the terminal pair of the present disclosure.

(13) As one aspect of the connector pair of the present disclosure, the insertion force of the male connector into the female connector is 50 N or less.

If the insertion force of the male connector is 50 N or less, the male connector and the female connector can be manually connected. Thus, a connector connecting operation is easy and excellent in connection operability.

DETAILS OF EMBODIMENT OF PRESENT DISCLOSURE

Hereinafter, specific examples of a terminal, a connector, a terminal pair and a connector pair according to embodiments of the present disclosure are described with reference to the drawings. The same reference numerals in figures denote the same terms. Note that the present invention is not limited to these examples and is intended to include all modifications within the scope of claims and within the meaning and scope of equivalents.

<Terminal>

Figure 2:
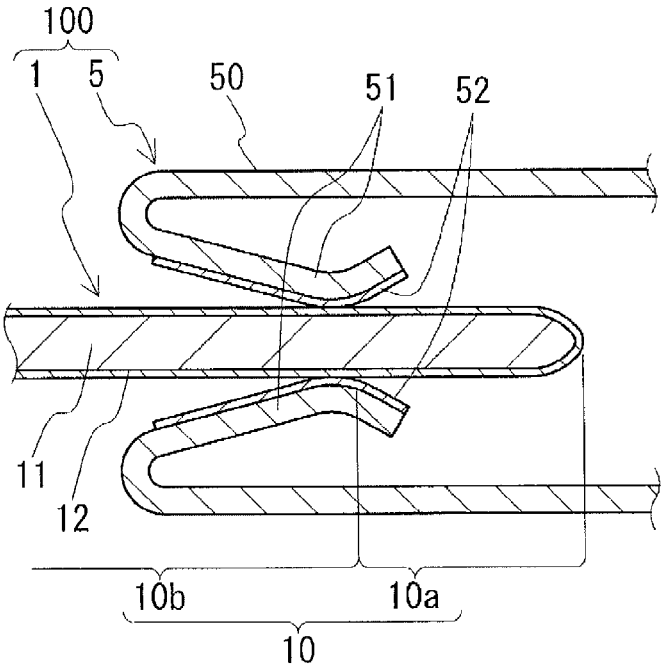
FIG. 2 is a schematic partial section of the examples of the terminal and the terminal pair according to the embodiment showing a state after insertion.

A terminal 1 according to the embodiment is described with reference to FIGS. 1 to 4. The terminal 1 according to the embodiment includes a connecting portion 10 to be electrically connected by being inserted into a mating terminal 5 as shown in FIGS. 1 and 2. The connecting portion 10 has a sliding region 10*a* configured to slide on the mating terminal 5 and a contact region 10*b* configured to contact the mating terminal 5 successively from a tip side. One of features of the terminal 1 according to the embodiment is that an outermost surface in the sliding region 10*a* of the connecting portion 10 has a copper-tin alloy (Cu—Sn alloy layer) 21 and an outermost surface in the contact resistance 10*b* of the connecting portion 10 has a tin layer (Sn layer) 22.

Figure 3:
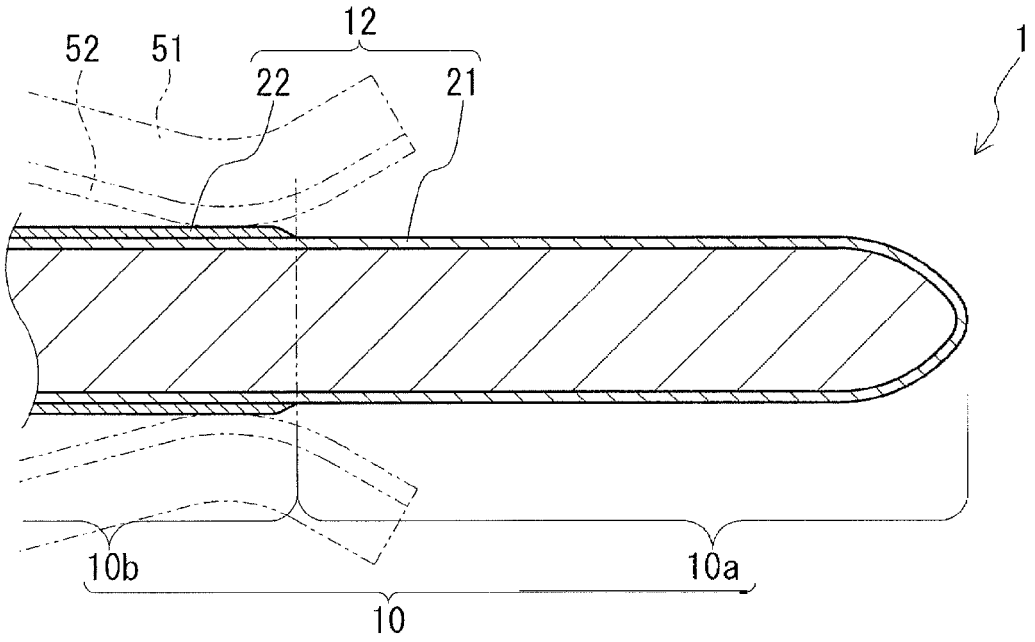
FIG. 3 is a schematic partial section enlargedly showing a connecting portion of the terminal according to the embodiment.
Figure 4:
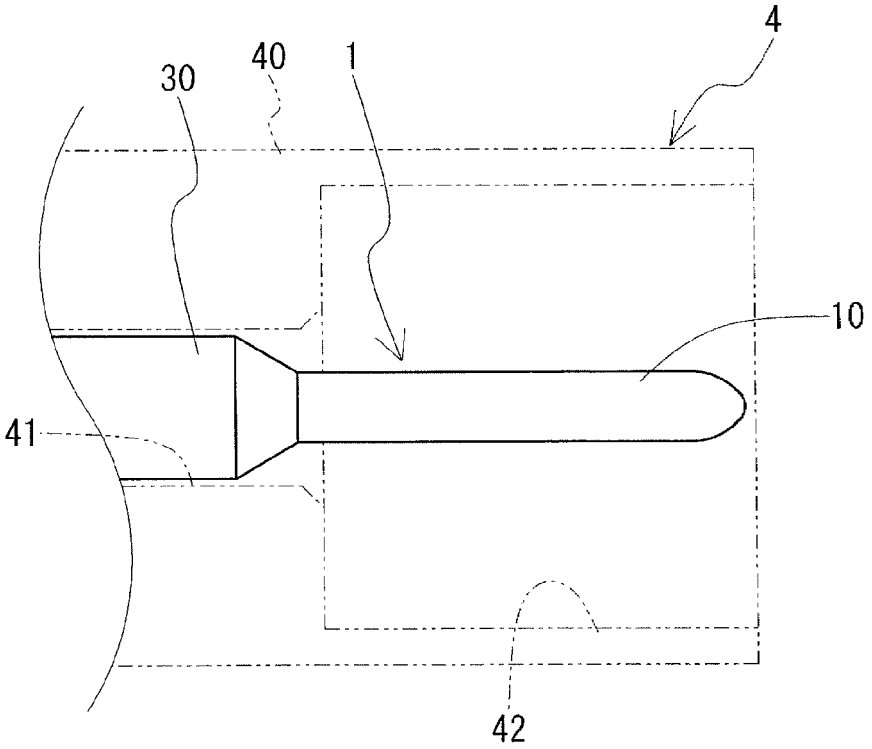
FIG. 4 is a schematic partial section showing an example of a connector according to an embodiment.

FIGS. 1 and 2 are partial sections of the connecting portion 10 of the terminal 1 viewed laterally. FIG. 1 shows a state before the terminal 1 (connecting portion 10) is inserted into the mating terminal 5. FIG. 2 shows a state after the terminal 1 (connecting portion 10) is inserted into the mating terminal 5. FIG. 3 is a partial section enlargedly showing a cross-section of the connecting portion 10 of the terminal 1 viewed laterally. FIG. 4 is a view of a connector 4 including the terminal 1 viewed laterally. In the following description, upper and lower sides in each figure are referred to as upper and lower sides. In the terminal 1, a side to be inserted into the mating terminal 5 (inserting direction of the connecting portion 10) is referred to as a front side and an opposite side is referred to as a rear side. In the mating terminal 5, a side into which the terminal 1 (connecting portion 10) is inserted is referred to as a front side and an opposite side is referred to as a rear side.

<Summary>

The terminal 1 includes a body portion 30 (see FIG. 4) and the connecting portion 10 to be inserted into the mating terminal 5 (see FIGS. 1 and 2). As shown in FIG. 4, the connecting portion 10 is formed to extend forward from the body portion 30. A wire connecting portion (not shown) to be crimped to a conductor of a wire is provided behind the body portion 30. As shown in FIG. 2, the connecting portion 10 contacts the mating terminal 5 by being inserted into the mating terminal 5. In this way, the connecting portion 10 is electrically connected to the mating terminal 5.

The terminal 1 only has to be electrically connected to the mating terminal 5 by inserting the connecting portion 10. The type and shape of the terminal 1 do not particularly matter. Specific examples of the terminal 1 include a male terminal and a press-fit terminal. In this embodiment, a case where the terminal 1 is a male terminal is illustrated as an example (hereinafter, the terminal 1 may be referred to as the male terminal 1). The shape and dimensions of the connecting portion 10 do not particularly matter. Examples of the shape of the connecting portion 10 include a plate-like shape and a rod-like shape.

(Mating Terminal)

The mating terminal 5 contacts the inserted terminal 1 (connecting portion 10) to be electrically connected. The type and shape of the mating terminal 5 do not particularly matter if the type and shape are compatible with the terminal 1. The mating terminal 5 is, for example, a female terminal if the terminal 1 is a male terminal, and is a through hole formed in a circuit board if the terminal 1 is a press-fit terminal. In this embodiment, the mating terminal 5 is a female terminal (hereinafter, the mating terminal 5 may be referred to as the female terminal 5).

The mating terminal 5 includes a connecting portion 50 into which the connecting portion 10 of the terminal 1 is inserted. The configuration of the connecting portion 50 is not particularly limited and a known configuration can be employed. In this embodiment, the connecting portion 50 is formed into a tubular shape and includes a pair of resilient contact pieces 51 for vertically sandwiching the connecting portion 10 inside. The pair of resilient contact pieces 51 are provided to face each other inside the connecting portion 50 while being vertically spaced apart. Each resilient contact piece 51 is formed by being folded rearward from a front side of the connecting portion 50 and curved such that a central part thereof bulges inwardly of the connecting portion 50. If the connecting portion 10 of the terminal 1 is inserted into the connecting portion 50 as shown in FIG. 2, the resilient contact pieces 51 are pushed wider apart in the vertical direction by the connecting portion 10. By sandwiching the connecting portion 10 between the resilient contact pieces 51, each resilient contact piece 51 is resiliently deformed and contacts the connecting portion 10. Thus, with the connecting portion 10 inserted in the connecting portion 50, contact loads act from the pair of resilient contact pieces 51 to press the connecting portion 10. An interval between the resilient contact pieces 51 is set smaller than a thickness (vertical dimension in FIG. 1) of the connecting portion 10 in the state before the connecting portion 10 is inserted. The interval between the resilient contact pieces 51 is a distance between closest parts of the resilient contact pieces 51 facing each other.

In this embodiment, the resilient contact piece 51 has a Sn layer 51 on a surface which contacts the connecting portion 10. The Sn layer 52 is formed by plating Sn. Specifically, the Sn layer 52 is a reflow Sn plating layer formed by applying a reflow process after Sn plating. Further, the Sn layer 52 may be formed on the entire surface of the mating terminal 5.

A base material of the terminal 1 and the mating terminal 5 is a known metal material used as a terminal material such as copper, copper alloy, aluminum or aluminum alloy. Examples of the copper alloy include brass (Cu—Zn alloy), phosphor bronze (Cu—Sn—P alloy) and Corson alloy (Cu—Ni—Si alloy).

The configuration of the terminal 1 according to the embodiment is described in detail below.

(Connecting Portion)

The connecting portion 10 includes a base material portion 11 and a coating portion 12 covering the surface of the base material portion 11 as shown in FIG. 1. The base material portion 11 is made of the aforementioned metal material such as copper or copper alloy. In this embodiment, the base material portion 11 is made of copper or copper alloy. Further, the connecting portion 10 has a flat plate shape.

Dimensions of the connecting portion 10 are appropriately set according to the use application of the terminal 1 and the like. For example, in the case of a male terminal of an in-vehicle connector, a width (dimension in a depth direction in FIG. 1) of the connecting portion 10 is, for example, 0.3 mm or more and 3.0 mm or less, preferably 0.5 mm or more. A thickness (vertical dimension in FIG. 1) of the connecting portion 10 is, for example, 0.2 mm or more and 1.5 mm or less, preferably 0.3 mm or more and 1.0 mm or less. A length (lateral dimension in FIG. 1) of the connecting portion 10 is, for example, 2.0 mm or more and 10.0 mm or less, preferably 3.0 mm or more and 7.0 mm or less. Here, the length of the connecting portion 10 means a length from a position in contact with the front end of the connecting portion 50 to the tip of the connecting portion 10 when the connecting portion 10 is inserted into the connecting portion 50 (see FIG. 2), assuming that an inserting direction of the connecting portion 10 into the mating terminal 5 (connecting portion 50) is a length direction. In other words, the length of the connecting portion 10 is an inserted length into the connecting portion 50 when the connecting portion 10 is inserted into the connecting portion 50. Further, the width and thickness of the connecting portion 10 mean a longest dimension and a shortest dimension when the connecting portion 10 is viewed from directions orthogonal to the inserting direction.

Since the width of the connecting portion 10 is 0.3 mm or more and 3.0 mm or less, a sufficient contact area with the connecting portion 50 (resilient contact pieces 51) of the mating terminal 5 is easily secured.

(Sliding Region/Contact Region)

As shown in FIGS. 1 and 2, the connecting portion 10 has the sliding region 10*a* and the contact region 10*b* successively from the tip side (front side). The sliding region 10*a* is a region which slides on the resilient contact pieces 51 to guide the connecting portion 10 when the connecting portion 10 is inserted into the mating terminal 5 (connecting portion 50). The contact region 10*b* is a region which contacts the resilient contact pieces 51 for electrical connection when the connecting portion 10 is inserted into the mating terminal 5 (connecting portion 50).

(Coating Portion)

The configuration of the coating portion 12 in the sliding region 10*a* and the contact region 10*b* is shown in FIG. 3. As shown in FIG. 3, an outermost surface of the coating portion 12 in the sliding region 10*a* has the Cu—Sn alloy layer 21. An outermost surface of the coating portion 12 in the contact region 10*b* has the Sn layer 22. A Vickers hardness of the Cu—Sn alloy layer 21 is higher than that of the Sn layer 22.

(Cu—Sn Alloy Layer)

The Cu—Sn alloy layer 21 contains Cu and Sn. The Cu—Sn alloy layer 21 is made of a Cu—Sn based intermetallic compound containing C and Sn by alloying Cu and Sn. The Cu—Sn based intermetallic compound is harder than Sn. Thus, a surface in the sliding region 10*a* is hard by having the Cu—Sn alloy layer 21 on the outermost surface in the sliding region 10*a*. Therefore, a friction coefficient in the sliding region 10*a* is low. As a result, an insertion force into the mating terminal 5 can be reduced when the connecting portion 10 is inserted into the connecting portion 50 of the mating terminal 5 as shown in FIGS. 1 and 2.

(Composition)

Examples of the composition of the Cu—Sn based intermetallic compound constituting the Cu—Sn alloy layer 21 include $Cu_6Sn_5$ and $Cu_3Sn$. The Cu—Sn alloy layer 21 contains Cu not less than Sn in a mass ratio. The Cu—Sn alloy layer 21 contains, for example, 50 mass % or more of Cu. Particularly, the mass ratio of Cu to Sn is, for example, 1.0 or more and 2.5 or less, preferably 1.0 or more and 1.5 or less. Here, $Cu_6Sn_5$ has a lower electrical resistance than $Cu_3Sn$. Thus, the Cu—Sn alloy layer 21 preferably contains an intermetallic compound having the composition of $Cu_6Sn_5$. If the mass ratio of Cu to Sn is 1.0 or more and 2.5 or less, an intermetallic compound having the composition of $Cu_6Sn_5$ is easily formed. Thus, the electrical resistance of the Cu—Sn alloy layer 21 can be reduced. If the coating portion 12 in the contact region 10*b* has a multi-layer structure by forming the Sn layer 22 on the Cu—Sn alloy layer 21 as in this embodiment, the electrical resistance of the coating portion 12 in the contact region 10*b* can be reduced.

The Cu—Sn alloy layer 21 may contain elements other than Cu and Sn as additive elements. Examples of additive elements contained in the Cu—Sn alloy layer 21 include zinc (Zn), phosphor (P), nickel (Ni), silicon (Si), aluminum (Al), iron (Fe), silver (Ag), sulfur (S) and oxygen (O). The total content of the additive elements in the Cu—Sn alloy layer 21 is, for example, 10 mass % or less, preferably 5 mass % or less.

(Vickers Hardness)

The Vickers hardness of the Cu—Sn alloy layer 21 is, for example, 350 Hv or more and 630 Hv or less. As the Vickers hardness of the Cu—Sn alloy layer 21 increases, the surface in the sliding region 10*a* becomes harder and, hence, the friction coefficient tends to decrease. If the Vickers hardness of the Cu—Sn alloy layer 21 is 350 Hv or more and 630 Hv or less, the surface in the sliding region 10*a* is sufficiently hard and the friction coefficient is easily sufficiently reduced. Thus, an effect of reducing the insertion force by the Cu—Sn alloy layer 21 is easily obtained. The Vickers hardness of the Cu—Sn alloy layer 21 is preferably 370 Hv or more, more preferably 390 Hv or more and particularly preferably 400 Hv or more.

(Thickness)

A thickness of the Cu—Sn alloy layer 21 is, for example, 0.2 μm or more and 2.0 μm or less. If the thickness of the Cu—Sn alloy layer 21 is 0.2 μm or more, the effect of reducing the insertion force by the Cu—Sn alloy layer 21 is easily obtained. If the Cu—Sn alloy layer 21 is too thick, any further effect of reducing the insertion force cannot be expected. If the coating portion 12 in the contact region 10*b* has a multi-layer structure by forming the Sn layer 22 on the Cu—Sn alloy layer 21 as in this embodiment, the electrical resistance of the coating portion 12 in the contact region 10*b* increases if the Cu—Sn alloy layer 21 is too thick. Thus, an upper limit of the thickness of the Cu—Sn alloy layer 21 is set at 2.0 μm or less. The thickness of the Cu—Sn alloy layer 21 is preferably 0.4 μm or more and 1.2 μm or less.

(Sn Layer)

The Sn layer 22 contains Sn as a main component. The content of Sn as a main component includes a case where the Sn layer 22 is substantially made of Sn and means that the content of Sn in the Sn layer 22 is 95 mass % or more, preferably 99 mass % or more. That is, the Sn layer 22 may contain 5 mass % or less, preferably 1 mass % or less of elements other than Sn as the additive elements. Examples of the additive elements contained in the Sn layer 22 include Cu, Zn, P, Ni, Si, Al, Fe, Ag, S and O.

By having the Sn layer 22 on the outermost surface in the contact region 10*b*, a surface in the contact region 10*b* is relatively soft. Thus, when the connecting portion 10 is inserted into the connecting portion 50 of the mating terminal 5 as shown in FIGS. 1 and 2, contact with the resilient contact pieces 51 can be stabilized. As a result, the contact resistance with the mating terminal 5 can be reduced.

(Vickers Hardness)

The Vickers hardness of the Sn layer 22 is, for example, 20 Hv or more and 40 Hv or less. If the Vickers hardness of the Sn layer 22 is 20 Hv or more and 40 Hv or less, contact with the resilient contact pieces 51 can be more stabilized. Thus, the contact resistance with the mating terminal 5 is stably easily maintained low. Thus, an effect of reducing the contact resistance by the Sn layer 22 is easily obtained. The Vickers hardness of the Sn layer 22 is preferably 25 Hv or more and 35 Hv or less.

(Thickness)

A thickness of the Sn layer 22 is, for example, 0.2 μm or more and 2.0 μm or less. If the thickness of the Sn layer 22 is 0.2 μm or more, the effect of reducing the contact resistance by the Sn layer 22 is easily obtained. If the Sn layer 22 is too thick, any further effect of reducing the contact resistance cannot be expected. Rather, the electrical resistance of the coating portion 12 in the contact region 10*b* increases. Thus, an upper limit of the thickness of the Sn layer 22 is set at 2.0 μm or less. The thickness of the Sn layer 22 is preferably 0.4 μm or more and 1.2 μm or less.

In this embodiment, the coating portion 12 in the contact region 10*b* has a multi-layer structure by forming the Sn layer 22 on the Cu—Sn alloy layer 21. In the contact region 10*b*, a total thickness of the Cu—Sn alloy layer 21 and the Sn layer 22 is, for example, 0.4 μm or more and 4.0 μm or less. If the coating portion 12 in the contact region 10*b* has a multi-layer structure of the Cu—Sn alloy layer 21 and the Sn layer 22, a thickness of the coating portion 12 is larger in the contact region 10*b* than in the sliding region 10*a*.

The compositions of the Cu—Sn alloy layer 21 and the Sn layer 22 can be measured, for example, by an energy dispersive X-ray spectrum analyzer (EDX) or the like. Specifically, the composition is obtained by quantitatively analyzing the contents of elements in each layer using the EDX for each of the Cu—Sn alloy layer 21 and the Sn layer 22.

The Vickers hardnesses of the Cu—Sn alloy layer 21 and the Sn layer 22 can be measured, for example, by a micro surface material system or the like. Specifically, the Vickers hardnesses of arbitrary different locations are measured at 10 or more points for each of the Cu—Sn alloy layer 21 and the Sn layer 22, and an average value of the Vickers hardnesses in each layer is assumed as the Vickers hardness of that layer. A test load can be selected according to the thickness and hardness of each layer. The test load is, for example, set at about 5 mN or more and 20 mN or less. Specifically, the test load is reduced as the layer to be measured becomes thinner. For example, if the above thickness is 1 μm or less, the test load is set at 5 mN or more and 10 mN or less. If the above thickness is more than 1 μm and 2 μm or less, the test load is set at more than 10 mN and 20 mN or less.

The thicknesses of the Cu—Sn alloy layer 21 and the Sn layer 22 can be measured, for example, by a fluorescent X-ray film thickness meter. Specifically, thicknesses of arbitrary different locations are measured at 10 or more points for each of the Cu—Sn alloy layer 21 and the Sn layer 22, and an average value of the thicknesses in each layer is assumed as the thickness of that layer.

(Method for Forming Coating Portion)

A method for forming the coating portion 12 (Cu—Sn alloy layer 21 and Sn layer 22) is described. The method for forming the coating portion 12 is, for example, the following method. First, Sn is plated to the surface of the base material portion 11 to form a Sn plating layer. This Sn plating layer forms the Cu—Sn alloy layer 21 by being alloyed with Cu, which is a constituting element of the base material portion 11, by a thermal diffusion treatment after plating. Plating may be electrolytic plating or electroless plating. At this time, the Sn plating layer is formed to be thicker in the contact region 10*b* than in the sliding region 10*a*. This is because a thickness of the Sn plating layer directly becomes the thickness of the Cu—Sn alloy layer 21 in the sliding region 10*a* and the total thickness of the Cu—Sn alloy layer 21 and the Sn layer 22 in the contact region 10*b*. Specifically, the thickness of the Sn plating layer in the contact region 10*b* is made larger than that of the Sn plating layer in the sliding region 10*a* by 0.5 μm or more. A method for making the thickness of the Sn plating layer different in the sliding region 10*a* and the contact region 10*b* is, for example, a differential thickness plating method.

The Sn plating layer is thermally diffused after being formed. The thermal diffusion treatment is a thermal treatment for thermally diffusing Cu in the Sn plating layer. By the thermal diffusion treatment, Cu contained in the base material portion 11 is diffused into the Sn plating layer and Cu and Sn are alloyed. In this way, the Cu—Sn alloy layer 21 is formed. The thickness of the Sn plating layer is thicker in the contact region 10*b* than in the sliding region 10*a*. Thus, even if the entire Sn plating layer in the contact region 10*b* becomes the Cu—Sn alloy layer 21, the Sn plating layer in the contact region 10*b* can remain on a surface side. In the thermal diffusion treatment, a surface part of the Sn plating layer is caused to remain by preventing the entire Sn plating layer in the contact region 10*b* from becoming the Cu—Sn alloy layer 21. In this way, the Sn layer 22 is formed. The thermal diffusion treatment is performed at a temperature at which the Sn plating layer is not melted, specifically, below a melting point (230° C.) of Sn. The temperature of the thermal diffusion treatment is, for example, 100° C. or higher and 220° C. or lower, preferably 120° C. or higher and 200° C. or lower. A thermal diffusion process time is, for example, 1 hour or more and 200 hours or less, preferably 2 hours or more and 150 hours or less. As the thermal diffusion treatment time becomes longer, the amount of Cu diffused into the Sn plating layer increases and the Cu—Sn alloy layer 21 becomes thicker. Accordingly, the thermal diffusion treatment time is appropriately set such that the Sn plating layer in the sliding region 10*a* becomes the Cu—Sn alloy layer 21 up to the surface and the surface part of the Sn plating layer in the contact region 10*b* remains to form the Sn layer 22.

A reflow process may be applied to the Sn plating layer before the above thermal diffusion treatment is performed after the Sn plating layer is formed. By melting the Sn plating layer once by the reflow process, the growth of whiskers can be effectively suppressed. The reflow process is performed at the melting point (230° C.) of Sn or higher. That is, the temperature of the thermal diffusion treatment is lower than that of the reflow process. The temperature of the reflow process is, for example, 230° C. or higher and 400° C. or lower, preferably 240° C. or higher and 350° C. or lower.

The thermal diffusion treatment and the reflow process can be performed, for example, using a heating furnace. The reflow process may be performed by irradiating a laser beam. The laser beam is, for example, a YAG (yttrium-aluminum-garnet) laser beam or semiconductor laser beam. An output of the laser beam may be appropriately set so that the Sn plating layer can be heated to a predetermined temperature. An atmosphere of the thermal diffusion treatment and the reflow process may be an air atmosphere or nitrogen atmosphere.

If the base material portion 11 is made of a metal material other than copper or copper alloy, Cu may be plated to the surface of the base material portion 11 to form a Cu plating layer before the Sn plating layer is formed. Examples of the metal material other than copper or copper alloy include aluminum or aluminum alloy. In this case, the Sn plating layer is formed on the surface of the Cu plating layer after the Cu plating layer is formed on the surface of the base material portion 11. By performing the thermal diffusion treatment after the Sn plating layer is formed, Cu contained in the Cu plating layer can be diffused into the Sn plating layer and the Cu—Sn alloy layer 21 can be formed. Of course, even if the base material portion 11 is made of copper or copper alloy, the Cu plating layer may be formed on the surface of the base material portion 11.

Further, an underlayer may be formed on the surface of the base material portion 11 before the Sn plating layer and the Cu plating layer are formed. The underlayer is, for example, a Ni plating layer formed by plating Ni or Ni alloy. In this case, the Cu plating layer may be formed on the surface of the underlayer before the Sn plating layer is formed. The underlayer enhances the adhesion of the coating portion 12 to the base material portion 11 and suppresses the diffusion of constituting elements of the base material portion 11 into the Sn plating layer by the thermal diffusion treatment. A thickness of the underlayer is, for example, 0.1 μm or more and 2.0 μm or less.

(Length of Sliding Region)

A length of the sliding region 10*a* is, for example, 0.5 mm or more and 5.0 mm or less. By setting the length of the sliding region 10*a* at 0.5 mm or more and 5.0 mm or less, the insertion force into the mating terminal 5 is easily sufficiently reduced. The length of the sliding region 10*a* is a distance over which the connecting portion 10 slides on the resilient contact pieces 51 in the inserting direction. The length of the sliding region 10*a* is preferably 2.0 mm or more.

<Main Effects>

The terminal 1 of this embodiment has a small friction coefficient in the sliding region 10*a* by having the Cu—Sn alloy layer 21 on the outermost surface in the sliding region 10*a*. Further, the contact resistance with the mating terminal 5 can be reduced by having the Sn layer 22 on the outermost surface in the contact region 10*b*. Thus, the terminal 1 can reduce the contact resistance with the mating terminal 5 while reducing the insertion force into the mating terminal 5.

<Use Application>

The terminal 1 of this embodiment can be utilized, for example, as a male terminal of an in-vehicle connector.

<Connector>

The connector 4 according to an embodiment is described with reference to FIG. 4. The connector 4 includes the terminal 1 of the embodiment described above and a housing 40 for accommodating the terminal 1. In this embodiment, the connector 4 in which the terminal 1 is a male terminal is illustrated as an example (hereinafter, the connector 4 may be referred to as the male connector 4). The connector 4 shown in FIG. 4 has one terminal 1.

(Housing)

The configuration of the housing 40 is not particularly limited and a known configuration can be employed. The housing 40 shown in FIG. 4 includes an accommodation chamber 41 for holding the body portion 30 of the terminal 1 and a tubular portion 42 formed to surround the connecting portion 10. The accommodation chamber 41 is provided to penetrate through the housing 40 in the front-rear direction. By inserting the body portion 30 into the housing 40 from behind (left side in FIG. 4), the body portion 30 is fit into the accommodation chamber 41.

(Number of Terminals)

Although one terminal 1 is illustrated in this embodiment, the number of the terminal(s) 1 can be selected as appropriate. Two or more terminals 1 may be provided. For example, 10 or more, 20 or more or 30 or more terminals 1 may be provided. An upper limit of the number of the terminals 1 is not particularly limited but, for example, 200 or less, preferably 100 or less. If two or more terminals 1 are provided, the connector 4 having a multipolar structure can be configured. In this case, the housing 40 includes as many accommodation chambers 41 as the terminals 1.

<Main Effects>

The connector 4 of this embodiment includes the terminal 1 of the embodiment described above. Thus, a reduction of the insertion force and a reduction of the contact resistance can be effectively combined. Further, the terminal 1 requires a small insertion force and has a low contact resistance. Thus, even if two or more terminals 1 are provided, an insertion force per terminal is small. Thus, an insertion force required to connect the connector 4 can be small.

<Use Application>

The connector 4 of the embodiment can be utilized, for example, as a male connector of an in-vehicle connector.

<Terminal Pair>

A terminal pair 100 according to an embodiment is described with reference to FIGS. 1 and 2. The terminal pair 100 includes the male terminal 1 and the female terminal 5 described in the above embodiment.

(Contact Load of Female Terminal)

A contact load of the female terminal 5 with the male terminal 1 inserted therein is, for example, 1.0 N or more and 10 N or less. In the case of this embodiment, the contact load of the female terminal 5 is a stress acting on the connecting portion 10 from the pair of resilient contact pieces 51 with the connecting portion 10 sandwiched between the resilient contact pieces 51. The contact load of the female terminal 5 is preferably 7.0 N or less, particularly preferably 5.0 N or less.

The contact load of the female terminal 5 can be, for example, obtained as follows. A relationship of a displacement amount of the resilient contact pieces 51 (interval between the resilient contact pieces 51) and the contact load when the resilient contact pieces 51 are pushed wider apart is measured in advance by an experiment. The contact load is obtained based on the thickness of the connecting portion 10 from data measured in advance.

<Main Effects>

The terminal pair 100 of the embodiment includes the male terminal 1 of the above embodiment. Thus, the contact resistance between the male terminal 1 and the female terminal 5 can be reduced while the insertion force of the male terminal 1 into the female terminal 5 can be reduced.

Further, as the contact load of the female terminal 5 increases, connection reliability between the male terminal 1 and the female terminal 5 is improved and the contact resistance tends to decrease. Further, since the contact load and the insertion force are in a proportional relationship, the insertion force of the male terminal 1 into the female terminal 5 decreases as the contact load of the female terminal 5 decreases. By setting the contact load of the female terminal 5 at 1.0 N or more, connection reliability between the male terminal 1 and the female terminal 5 is easily maintained. If the contact load of the female terminal 5 exceeds 10 N, the effect of reducing the insertion force is hardly obtained even if the friction coefficient is small. Thus, an upper limit of the contact load of the female terminal 5 is set at 10 N or less.

<Use Application>

The terminal pair 100 of the embodiment can be utilized, for example, as a terminal pair of an in-vehicle connector.

<Connector Pair>

A connector pair 200 according to an embodiment is described with reference to FIG. 5. The connector pair 200 is provided with the terminal pair 100 of the above embodiment, a male connector 4 including the male terminal 1 and a female connector 8 including the female terminal 5. Since the male connector 4 has the same configuration as the connector of the above embodiment, repeated description is omitted.

(Female Connector)

Figure 5:
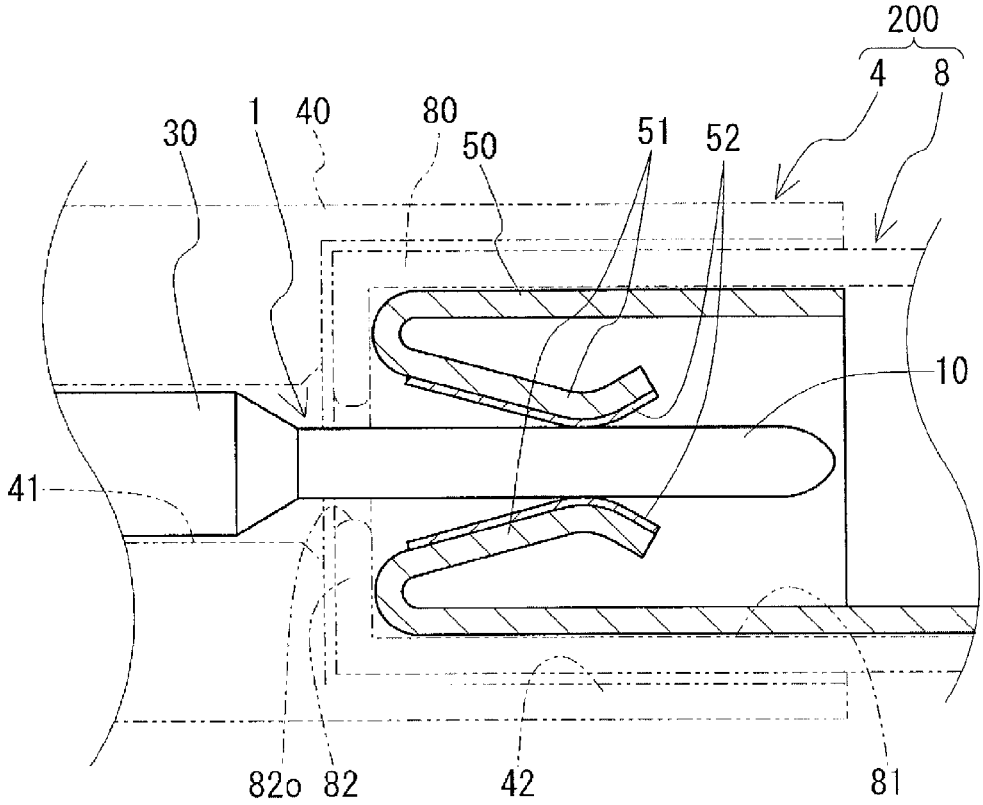
FIG. 5 is a schematic partial section showing an example of a connector pair according to an embodiment.

The female connector 8 shown in FIG. 5 includes a housing 80 for accommodating the female terminal 5. The housing 80 shown in FIG. 5 includes an accommodation chamber 81 for holding the connecting portion 50 of the female terminal 5. A front wall portion 82 is provided on a front side (left side in FIG. 5) of the accommodation chamber 81. A rear side (right side in FIG. 5) of the accommodation chamber 81 is open. By inserting the connecting portion 50 into the accommodation chamber 81 from behind the housing 80, the connecting portion 50 is fit into the accommodation chamber 81. The front wall portion 82 is provided with an insertion opening 82*o* allowing the insertion of the connecting portion 10 of the male terminal 1 into the connecting portion 50.

In this embodiment, as shown in FIG. 5, the housing 80 is fit into the tubular portion 42 of the housing 40 when the male connector 4 and the female connector 8 are connected by inserting the male connector 4 into the female connector 8.

If the male connector 4 includes a plurality of the terminals 1, the female connector 8 includes as many female terminals 5 as the male terminals 1. In this case, the housing 80 is provided with accommodation chambers 81 so that the female terminals 5 are respectively arranged at positions corresponding to the respective male terminals 1.

(Insertion Force of Male Connector)

An insertion force of the male connector 4 into the female connector 8 is, for example, 50 N or less. If the insertion force of the male connector 4 is 50 N or less, the male connector 4 and the female connector 8 can be manually connected. Thus, a connector connecting operation is easy and excellent in connection operability. The insertion force of the male connector 4 can be roughly estimated by multiplying an insertion force per terminal by the number of the terminal pairs. For example, if 50 male terminals 1 are provided in the male connector 4, the insertion force of the male connector 4 can be set at 50 N or less if the insertion force per terminal is 1 N or less.

The insertion force of the male connector 4 can be, for example, measured by a precision load testing machine or the like. Specifically, the insertion force can be measured by the precision load testing machine (e.g. Model-1605N produced by Aikoh Engineering Co., Ltd.). An example of an insertion force measurement method is described. The female connector 8 is fixed to a fixing chuck of the precision load testing machine (e.g. Model-1605N produced by Aikoh Engineering Co., Ltd.) such that the insertion opening 82*o* is facing up. Further, a load cell having the male connector 4 mounted thereon is fixed to a movable head such that the connecting portion 10 of the male terminal 1 is facing down. From this state, the male connector 4 is moved downward at a head speed of 10 mm/min to insert the connecting portion 10 into the female terminal 5 of the female connector 8. A load change until the insertion of the male terminal 1 into the female terminal 5 is completed is measured by the load cell and a measurement value is set as the insertion force.

Although not shown in this embodiment, a lever mechanism for applying a force in the inserting direction between the housing 40 and the housing 80 may be provided to reduce the insertion force of the male connector 4 into the female connector 8. By providing the lever mechanism, the male connector 4 and the female connector 8 are easily connected. The lever mechanism can employ a known configuration.

<Main Effects>

The connector pair 200 of the embodiment includes the terminal pair 100 of the above embodiment. Thus, the contact resistance between the male terminal 1 and the female terminal 5 can be reduced while the insertion force of the male terminal 1 into the female terminal 5 is reduced.

<Use Application>

The connector pair 200 of the embodiment can be utilized, for example, for a terminal pair of an in-vehicle connector.

Verification Example 1

The configuration of the terminal according to the embodiment including the Cu—Sn alloy layer on the outermost surface in the sliding region and the Sn layer on the outermost surface in the contact region was verified. Here, the following three types of samples were prepared.

(Sample No. 1)

Sn was plated to a surface of a Cu plate material by electrolytic plating to form a pure Sn plating layer having a thickness of 1 mm. After the Sn plating layer was formed, a reflow process was applied in a temperature range of 240° C. to 350° C. in an air atmosphere. Heating by the reflow process was finished and cooling to a room temperature was performed. Subsequently, a Cu—Sn alloy layer was formed on the surface of the Cu plate material by performing a thermal diffusion treatment in a heating atmosphere of 150° C. A thermal diffusion treatment time was set at about 100 hours. Further, acid cleaning was performed to remove scales, dust and the like deposited on the surface of the Cu—Sn alloy layer after the thermal diffusion treatment. An acid used in acid cleaning is, for example, a hydrochloric acid. The plate material formed with the Cu—Sn alloy layer was set as Sample No. 1.

The content of Cu was quantitatively analyzed for the formed Cu—Sn alloy layer, using an EDX (JSM-6480 produced by JEOL Ltd.). A mass ratio (Cu/Sn) of Cu to Sn calculated as a result was 1.2.

(Sample No. 2)

Sn was plated to a surface of a Cu plate material by electrolytic plating to form a Sn plating layer having a thickness of 1 mm. After the Sn plating layer was formed, a reflow process was applied in a temperature range of 240° C. to 350° C. in an air atmosphere. A Sn layer was formed on the surface of the Cu plate material by shortening a reflow process time and suppressing the diffusion of Cu into the Sn plating layer and the alloying of Cu and Sn. The plate material formed with the Sn layer was set as Sample No. 2.

(Sample No. 11)

A layer which includes a Cu—Sn alloy layer and a Sn layer and in which a Cu—Sn alloy portion formed by exposing the Cu—Sn alloy layer and a Sn portion formed by exposing the Sn layer coexist (hereinafter, referred to as an "alloy coexistence Sn layer") was formed on a surface of a Cu plate material based on a manufacturing method described in Japanese Patent Laid-open Publication No. 2015-149200. The plate material formed with the alloy coexistence Sn layer was set as Sample No. 11.

A thickness of each layer (Cu—Sn alloy layer, Sn layer, alloy coexistence Sn layer) formed on the surface of the Cu plate material was measured for each sample. The thickness of each layer in each sample was obtained by measuring thicknesses of arbitrary different locations at 10 or more points using a fluorescent X-ray film thickness meter (SFT9400 produced by Hitachi High-Tech Science Corporation) and calculating an average value. As a result, an average thickness of each layer in each sample was about 1 μm.

A Vickers hardness of each layer (Cu—Sn alloy layer, Sn layer, alloy coexistence Sn layer) formed on the surface of the Cu plate material was measured for each sample. The Vickers hardness of each layer in each sample was obtained by measuring Vickers hardnesses of arbitrary different locations at 10 or more points using a micro surface material system (MZT-500 produced by Mitutoyo Corporation) and calculating an average value. The Vickers hardness is measured in accordance with JIS Z 2244: 2009 "Vickers Hardness Test—Test Method". A test load was set at 5 mN. A result is shown below.

Sample No. 1 (Cu—Sn alloy layer): 440 Hv

Sample No. 2 (Sn layer): 30 Hv

Sample No. 11 (alloy coexistence Sn layer): 160 Hv

Figure 6:
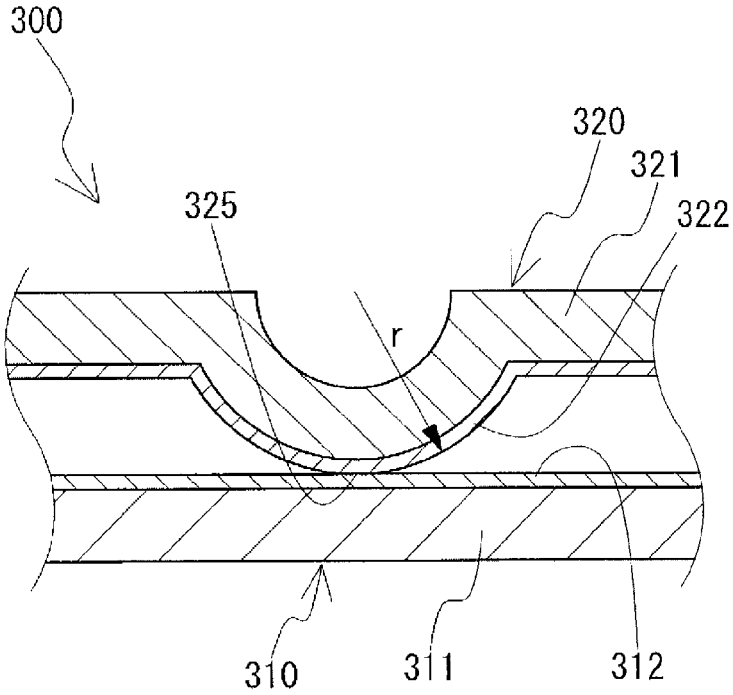
FIG. 6 is a view showing a test piece used in Verification Example 1.

A test piece 300 (flat plate piece 310 and embossed piece 320) as shown in FIG. 6 was fabricated for each sample. The flat plate piece 310 was fabricated by being cut out from each obtained sample. Further, the embossed piece 320 was fabricated by embossing a plate piece cut out from Sample No. 2 formed with the Sn layer. The test piece 300 is a combination of the flat plate piece 310 fabricated using each sample and the embossed piece 320 fabricated using Sample No. 2.

FIG. 6 shows a case where Sample No. 1 was used as an example of the test piece 300. The flat plate piece 310 was formed with a Cu—Sn alloy layer 312 on a surface of a Cu plate material 311. The embossed piece 320 was formed with a Sn layer 322 on a surface of a Cu plate material 321. The embossed piece 320 included a semispherical embossed portion 325 having a radius r of 1 mm in a central part.

<Test 1: Friction Coefficient>

For the effect of reducing the insertion force by the Cu—Sn alloy layer in the sliding region, a friction coefficient was measured using a test piece of each sample and verified. In this test, five test pieces were prepared for each sample.

The friction coefficient was measured as follows. As shown in FIG. 6, the flat plate piece 310 was horizontally arranged with the surface thereof faced up. The surface of the embossed piece 320 was faced down and the flat plate piece 310 and the embossed piece 320 were overlapped so that a top of the embossed portion 325 contacted the surface of the flat plate piece 310. With the top of the embossed portion 325 held in contact with the surface of the flat plate piece 310 and a contact load of 3 N applied, the embossed piece 320 was slid at a constant speed along the surface of the flat plate piece 310. A sliding speed was set at 10 mm/min, and a sliding distance was set at 5 mm. A dynamic friction force during a sliding movement was measured by a load cell. A (dynamic) friction coefficient was calculated by dividing the measured dynamic friction force by the contact load.

Figure 7:
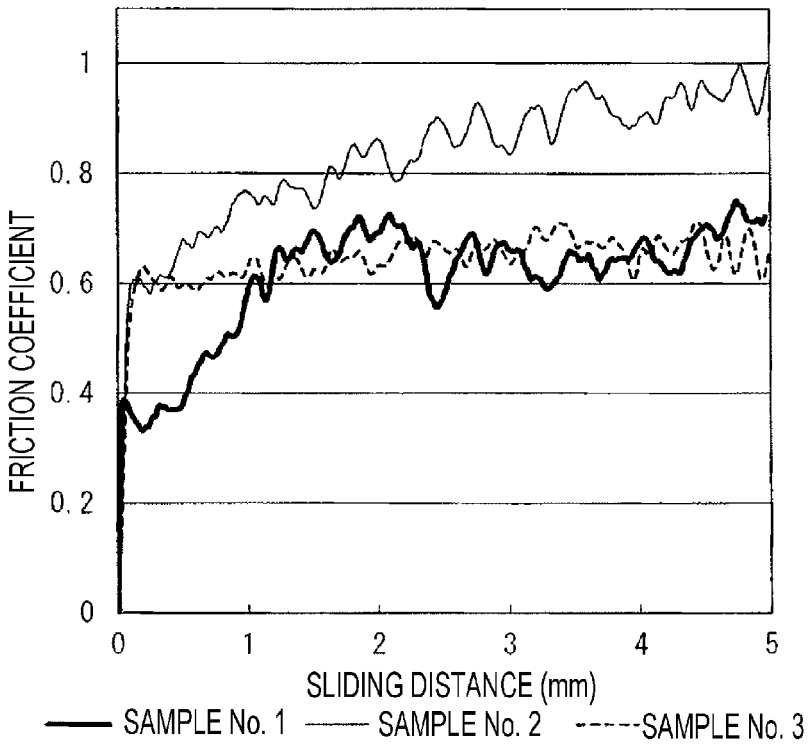
FIG. 7 is a graph showing a friction coefficient measurement result in Verification Example 1.

The friction coefficient was measured using five test pieces per one sample and an average value was set as a (dynamic) friction coefficient of that sample. A friction coefficient measurement result is shown in FIG. 7. A horizontal axis of FIG. 7 represents the sliding distance and a vertical axis represents the friction coefficient. FIG. 7 relatively shows relationships with a maximum value of the friction coefficient of Sample No. 2 having a large friction coefficient set as 1.

The insertion force of the terminal depends on the friction coefficient. The smaller the friction coefficient, the lower the insertion force. From the result shown in FIG. 7, it is found that the friction coefficient of Sample No. 1 including the Cu—Sn alloy layer can be drastically reduced as compared to Sample No. 2 including the Sn layer. Further, Sample No. 2 has about the same friction coefficient as Sample No. 11 including the alloy coexistence Sn layer in a sliding distance range of 1 mm or more. However, Sample No. 1 has a smaller friction coefficient than Sample No. 11 in a sliding distance range of less than 1 mm. That is, Sample No. 1 has a small friction coefficient in an initial stage of sliding. It can be confirmed from this that the friction coefficient can be reduced by including the Cu—Sn alloy layer on the outermost surface in the sliding region of the terminal. Thus, the effect of reducing the insertion force is obtained.

<Test 2: Contact Resistance>

Contact resistance was measured using test pieces of Sample No. 2 and Sample No. 11 and verified for the effect of reducing the contact resistance by the Sn layer in the contact region.

The contact resistance was measured as follows. As shown in FIG. 6, the flat plate piece 310 was horizontally arranged with the surface thereof faced up. The flat plate piece 310 and the embossed piece 320 were so overlapped that the top of the embossed portion 325 contacted the surface of the flat plate piece 310 with the surface of the embossed piece 320 faced down. Subsequently, the contact resistance between the flat plate piece 310 and the embossed piece 320 was measured by a four-terminal method while the contact load was increased at a constant rate of 0.1 mm/min up to 10 N from a state where no contact load was applied.

Figure 8:
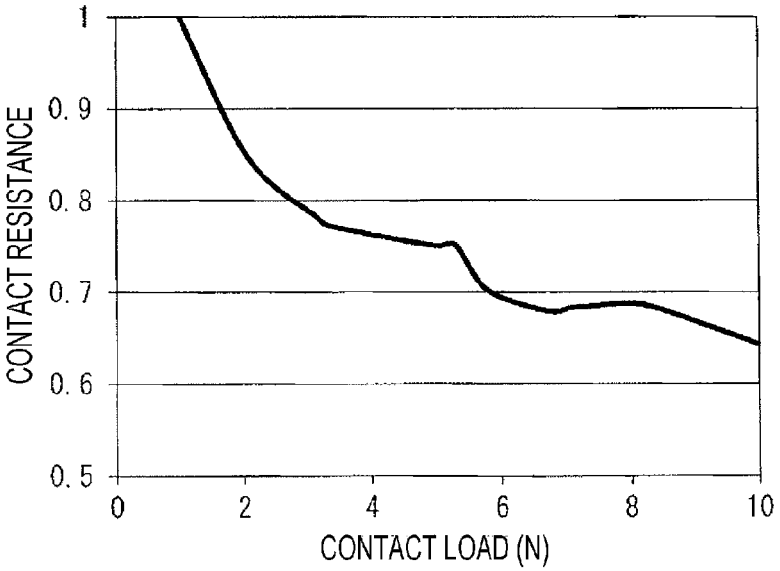
FIG. 8 is a graph showing a contact resistance measurement result in Verification Example 1.

FIG. 8 shows a contact resistance measurement result. A horizontal axis of FIG. 8 represents the contact load and a vertical axis represents the contact resistance when the contact resistance in Sample No. 11 is set as 1. That is, FIG. 8 relatively shows the contact resistance in Sample No. 2 with the contact resistance in Sample No. 11 set as 1.

From the result shown in FIG. 8, it is found that the contact resistance can be reduced at the same contact load in Sample No. 2 including the Sn layer as compared to Sample No. 11 including the alloy coexistence Sn layer. For example, the contact resistance of Sample No. 2 when the contact load is 3N is lower than that of Sample No. 11 by about 20%. It can be confirmed from this that the contact resistance can be reduced by including the Sn layer on the outermost surface in the contact region of the terminal.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A terminal, comprising:

a connecting body to be electrically connected to a mating terminal by being inserted into the mating terminal, wherein:

the connecting body has a sliding region configured to slide on the mating terminal and a contact region configured to contact the mating terminal successively from a tip side, an outermost surface in the sliding region includes a copper-tin alloy layer containing copper and tin, an outermost surface in the contact region includes a tin layer containing tin as a main component, and a Vickers hardness of the copper-tin alloy layer is higher than a Vickers hardness of the tin layer when a load is set at 5 mN or more and 20 mN or less.

2. The terminal of claim 1, wherein the Vickers hardness of the tin layer is 20 Hv or more and 40 Hv or less.

3. The terminal of claim 1, wherein the Vickers hardness of the copper-tin alloy layer is 350 Hv or more and 630 Hv or less.

4. The terminal of claim 1, wherein:

a thickness of the tin layer is 0.2 μm or more and 2.0 μm or less, and a thickness of the copper-tin alloy layer is 0.2 μm or more and 2.0 μm or less.

5. The terminal of claim 1, wherein a width of the connecting body is 0.3 mm or more and 3.0 mm or less.

6. The terminal of claim 1, wherein a length of the sliding region is 0.5 mm or more and 5.0 mm or less.

7. The terminal of claim 1, wherein a mass ratio of copper to tin is 1.0 or more and 2.5 or less in the copper-tin alloy layer.

8. A connector, comprising:

the terminal of claim 1; and a housing for accommodating the terminal.

9. The connector of claim 8, wherein two or more terminals are included.

10. A terminal pair, comprising:

a male terminal; and a female terminal, the male terminal being inserted into the female terminal, the male terminal being the terminal of claim 1.

11. The terminal pair of claim 10, wherein a contact load of the female terminal with the male terminal inserted is 1.0 N or more and 10 N or less.

12. A connector pair, comprising:

the terminal pair of claim 10;

a male connector including the male terminal; and a female connector including the female terminal.

13. The connector pair of claim 12, wherein an insertion force of the male connector into the female connector is 50 N or less.

14. The terminal of claim 1, wherein the copper-tin alloy layer further includes one or more selected from zinc, phosphor, nickel, silicon, aluminum, iron, silver, sulfur, and oxygen as additive elements.

15. The terminal of claim 14, wherein a total content of the additive elements in the copper-tin alloy layer is 10 mass % or less.

16. The terminal of claim 1, wherein a content of tin in the tin layer is 95 mass % or more.

17. The terminal of claim 1, wherein the tin layer further includes one or more selected from copper, zinc, phosphor, nickel, silicon, aluminum, iron, silver, sulfur, and oxygen as additive elements.

18. The terminal of claim 17, wherein a total content of the additive elements in the tin layer is 5 mass % or less.

* * * * *